US006102426A

United States Patent [19]

Lazarus et al.

[11] Patent Number: 6,102,426

[45] **Date of Patent: *Aug. 15, 2000**

[54] ADAPTIVE SPORTS IMPLEMENT WITH TUNED DAMPING

[75] Inventors: Kenneth B. Lazarus, Concord; Jeffrey W. Moore, Arlington; Robert N. Jacques, Hopkington; Farla M. Russo, Brookline; Ronald Spangler, Somerville, all of Mass.

[73] Assignee: Active Control eXperts, Inc., Cambridge, Mass.

[ * ] Notice: This patent is subject to a terminal disclaimer.

[21] Appl. No.: 08/797,004

[22] Filed: Feb. 7, 1997

[51] Int. Cl.[7] ..... A63C 5/07

[52] U.S. Cl. ..... 280/602; 280/610

[58] Field of Search ..... 280/602, 609, 280/607, 610, 809; 473/316, 524; 310/326, 327, 328

[56] References Cited

U.S. PATENT DOCUMENTS

| | | | |
|---|---|---|---|
| 4,565,940 | 1/1986 | Hubbard, Jr. | 310/326 |
| 4,849,668 | 7/1989 | Crawley et al. | 310/328 |
| 5,315,203 | 5/1994 | Bicos | 310/326 |
| 5,390,949 | 2/1995 | Naganathan et al. | 280/707 |
| 5,499,836 | 3/1996 | Juhasz | 280/602 |
| 5,775,715 | 7/1998 | Vandergrist | 280/602 |
| 5,857,694 | 1/1999 | Lazarus | 280/602 |

FOREIGN PATENT DOCUMENTS

| | | |
|---|---|---|
| 0 162 372 | 11/1985 | European Pat. Off. . |
| 2 643 430 | 8/1990 | France . |
| 25 02 031 | 7/1976 | Germany . |
| 465 603 | 7/1991 | Sweden . |
| Wo 95/20827 | 1/1995 | WIPO . |

OTHER PUBLICATIONS

Ashley, S., "Smart Skis and Other Adaptive Structures", *Mechanical Engineering*, vol. 117, No. 11, pp. 76–81 (1995).

Lynh, T., "Piezoelectric Damper Hones Ski performance", *Design News*, (Feb. 5, 1996).

*Primary Examiner*—Richard M. Camby
*Attorney, Agent, or Firm*—Testa Hurwitz & Thibeault

[57] ABSTRACT

A sports implement includes an electroactive element such as a piezoceramic sheet attached to the implement and a shunt circuit attached to the electroactive element to counteract strain or alter stiffness of the implement to affect its performance. In a ski, one shunt circuit is neither a linear nor a highly tuned shunt, but is a low Q resonant inductive shunt tuned to a performance band of the ski to enhance dissipation of energy from of the electroactive element. The performance band includes at least one structural mode of the ski and a neighborhood of that mode. The neighborhood may include variations in the frequency of a first or higher free structural resonance which arise from production variations or size variations of the ski or its components. The neighborhood may also be selected to cover the range of frequencies that mode takes when driven by actual disturbances in use, such as the vibrations excited when skiing at a particular range of speeds, or with a particular set of conditions or combination of conditions of temperature, speed, snow and terrain. In other embodiments, the tuned band shunt control may be switched to remove a resonance, adapt performance to different situations, or enhance handling or comfort of the implement. Other embodiments include striking implements intended to hit a ball or object in play, such as golf clubs and tennis racquets, wherein the strain elements may alter the performance, feel or comfort of the implement.

24 Claims, 4 Drawing Sheets

ADAPTIVE SPORTS IMPLEMENT WITH TUNED DAMPING

BACKGROUND OF THE INVENTION

The present invention relates to sports equipment, and more particularly to damping, controlling vibrations and affecting stiffness of sports equipment, such as a racquet, ski, or the like. In general, a great many sports employ implements which are subject to either isolated extremely strong impacts, or to large but dynamically varying forces exerted over longer intervals of time or over a large portion of their body. Thus, for example, implements such as baseball bats, playing racquets, sticks and mallets are each subject very high intensity impact applied to a fixed or variable point of their playing surface and propagating along an elongated handle that is held by the player. With such implements, the speed, performance or handling of the striking implement itself may be affected by the impact, and the resultant vibration may strongly jar the person holding it. Other sporting equipment, such as sleds, bicycles or skis, may be subjected to extreme impact as well as to diffuse stresses applied over a protracted area and a continuous period of time, and may evolve complex mechanical responses thereto. These responses may excite vibrations or may alter the shape of runners, frame, or chassis structures, or other air- or ground-contacting surfaces. In this case, the vibrations or deformations have a direct impact both on the degree of control which the driver or skier may exert over his path of movement, and on the net speed or efficiency of motion achievable therewith.

Taking by way of example the instance of downhill or slalom skis, basic mechanical considerations have long dictated that this equipment be formed of flexible yet highly stiff material having a slight curvature in the longitudinal and preferably also in the traverse directions. Such long, stiff plate-like members are inherently subject to a high degree of ringing and structural vibration, whether they be constructed of metal, wood, fibers, epoxy or some composite or combination thereof. In general, the location of the skier's weight centrally over the middle of the ski provides a generally fixed region of contact with the ground so that very slight changes in the skier's posture and weight-bearing attitude are effective to bring the various edges and running surfaces of the ski into optimal skiing positions with respect to the underlying terrain. This allows control of steering and travel speed, provided that the underlying snow or ice has sufficient amount of yield and the travel velocity remains sufficiently low. However, the extent of flutter and vibration arising at higher speeds and on irregular, bumpy, icy surfaces can seriously degrade performance. In particular, mechanical vibration leads to an increase in the apparent frictional forces or net drag exerted against the ski by the underlying surface, or may lead to a loss of control when blade-like edges are displaced so much that they fail to contact the ground. This problem particularly arises with modern skis, and analogous problems arise with tennis racquets and the like made with metals and synthetic materials that may exhibit much higher stiffness and elasticity than wood.

One practical approach for controlling vibration from arising has been to incorporate in a sports article such as a ski, an inelastic material which adds damping to the overall structure. Because of the trade-offs in weight, strength, stiffness and flexibility that are inherent in the approach of adding inelastic elements onto a ski, it is highly desirable to develop other, and improved, methods and structures for vibration control. Applicants have previously described in U.S. patent application Ser. No. 08/188,145 and corresponding published International Application WO95/20827 a modular packaged strain transducer unit which can not only change its own shape, but which couples strain across a surface. Applicants have furthermore described, in U.S. patent application Ser. No. 08/536,067 and corresponding International Application PCT/US96/15557 a construction wherein such strain transducer units are coupled in defined regions of a sports implement together with an active or passive circuit to damp, shift or otherwise control behavior of the implement under conditions of dynamic stimulation.

In implementing that technology, applicant created a sports damper wherein all or a portion of the body of a piece of sporting equipment has mounted thereto an electroactive assembly which couples strain across a region of the body of the sporting implement and alters the damping or stiffness of the body in response to strain occurring in the implement. Electromechanical actuation of the assembly adds or dissipates energy, effectively damping vibration as it arises, or alters the stiffness, changing the dynamic response of the equipment. The sporting implement is characterized as having a body with a root and one or more principal structural modes having nodes and regions of strain. The electroactive assembly is generally positioned near the root, to enhance or maximize its mechanical actuation efficiency. The assembly may be a passive component, converting strain energy to electrical energy and shunting the electrical energy, thus dissipating energy in the body of the sports implement. Alternatively it may be an active embodiment, in which the system includes an electroactive assembly with piezoelectric sheet material and a separate power source such as a replaceable battery. The battery is connected to a driver to selectively vary the mechanics of the assembly. For example, a sensing member in proximity to the piezoelectric sheet material may respond to dynamic conditions of strain occurring in the sports implement and provide output signals which are amplified by the power source for actuation of the first piezo sheets. A controller may include logic or circuitry to apply two or more different control rules for actuation of the sheet in response to the sensed signals, effecting different actuations of the first piezo sheet.

Applicant has constructed such a damper in a ski in which the electroactive assembly is surface bonded to or embedded within the body of the ski at a position a short distance ahead of the effective root location, i.e., ahead of the boot mounting. In a passive construction, the charge across the piezo elements in the assembly is shunted to dissipate the energy of strain coupled into the assembly, while in an active embodiment, a longitudinally displaced but effectively collocated sensor detects strain in the ski, and creates an output signal which is used as input or control signal to actuate the first piezo sheet. A single 9-volt battery powers an amplifier for the output signal, and this arrangement applies sufficient power for up to a day or more to operate the electroactive assembly as an active damping or stiffening control mechanism, shifting or dampening resonances of the ski and enhancing the degree of ground contact and the magnitude of attainable speeds. The foregoing technique is of general applicability; in other sports implements the piezoelectric element may attach to the handle or head of a racquet or striking implement to enhance handling characteristics, feel and performance.

As described in the aforesaid '067 patent application, using this resistive shunt control technique, the strain transducers are only able to effect a small level of damping, but this is applied over a broad frequency band. Thus, they are configured to continuously dissipate or redirect energy to prevent resonant excitation build-up, and the strain elements are preferably mounted in locations where they can capture strain energy from several excited modes. Further details of that construction are given in the aforesaid U.S. and International patent applications, all of which are hereby incorporated by reference.

However, in practice, an implement such as a ski is subject to very large disturbances at various frequencies depending upon the user and the environment. Thus, the shear-mounted strain element might not be able to affect the vibration levels occurring under some conditions, while in others practical experience and close observation may reveal particular states that could be advantageously controlled by coupled strain elements.

It is therefore desirable to increase the effectiveness of a strain element damper in a sports implement such as a ski.

It is also desirable to provide a dynamic strain element controller that is effective in the face of variations in the dynamics of the implement.

It is also desirable to provide a dynamic strain element controller that is effective in the face of variations occurring in electrical components used in the construction of the controller.

It is also desirable in particular to provide a strain element coupled to a ski and having an electrical control circuit tuned to a narrow ski frequency response band, wherein the response band encompasses a range of frequencies which may vary, due for example to velocity, terrain or device size and fabrication tolerances.

It is also desirable to provide a controller which enhances the levels of damping at one or more specific narrow frequency bands.

SUMMARY OF THE INVENTION

This is achieved in accordance with the present invention by providing a sports implement with a strain transducer mechanically shear-coupled to the implement and electrically coupled in a band-optimized shunt or driver circuit. In an illustrative embodiment, the implement is a ski and the ski has a strain assembly including one or more piezoelectric plates which are strain-coupled to the body of the ski, and which are electrically shunted by an R-L circuit. The resistor and inductor components together with the capacitance of the plates form a tuned circuit, of which the component values are selected such that the circuit preferentially shunts the electrical charge in the strain element over a frequency band surrounding a nominal target mode of the ski, hence damps motion of the ski. Band width is chosen based on an expected range of ski modal frequency values to include variations due to manufacturing and ski component variations, or to include the range of frequencies at which a given mode(s) may be forced as driving conditions vary. Preferably the band is broad enough to include both sources of variation, but excludes a range of frequencies characteristic of a distinct mode. In one embodiment, an inductive shunt circuit tuned to 80–120 Hz reduces third mode vibration by over fifty percent to enhance high-speed or frequent-impact skiing, but has lesser, or relatively little effect on the lower frequency first mode, at 10–15 Hz, which is not appreciably excited under these skiing conditions.

BRIEF DESCRIPTION OF THE DRAWINGS

These and other features of the invention will be understood from the description contained herein taken together with the illustrative drawings, wherein.

DETAILED DESCRIPTION

Figure 1:
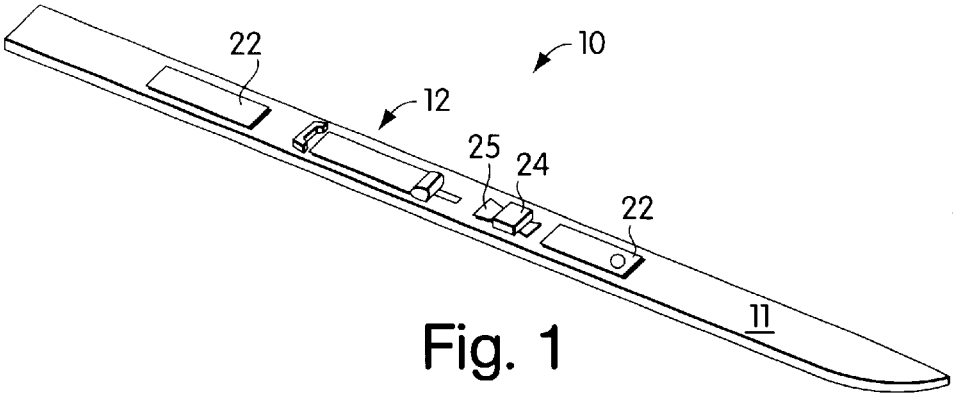
FIG. 1 shows a ski in accordance with the present invention.

FIG. 1 shows by way of example as an illustrative sports implement, a ski 10 embodying the present invention. Ski 10 has a generally elongated body 11, and mounting portion 12 centrally located along its length, which, for example, in a downhill ski includes one or more ski-boot support plates affixed to its surface, and heel and/or toe safety release mechanisms (not shown) fastened to the ski behind and ahead of the boot mounting plates, respectively. These latter elements are all conventional, and are not illustrated. It will be appreciated, however, that these features define a plate-mechanical system wherein the weight of a skier is centrally clamped on the ski, and makes this central portion a fixed point (inertially, and sometimes to ground) of the structure, so that the mounting region generally is, mechanically speaking, a root of a plate which extends outwardly therefrom along an axis in both directions. As further illustrated in FIG. 1, ski 10 of the present invention has an electroactive assembly 22 including a piezoelectric actuation sheet integrated with the ski or affixed thereto, and in some embodiments, a sensing sheet element 25 communicating with the electroactive sheet element and a power controller 24 in electrical communication with both the sensing and the electroactive sheet elements.

As more fully described in the aforesaid patent applications, the electroactive assembly and its piezoelectric sheet element are strain-coupled either within or to the surface of the ski, becoming an integral part of and providing stiffness to the ski body, and responding to strain therein by changing its electrical charge state. A circuit is attached to the strain element so as to apply or to dissipate electrical charge, thus changing the strain energy, and controlling vibrational modes of the ski and its response. The electroactive sheet elements 22 are preferably formed of piezoceramic material, which has a relatively high stiffness and high strain actuation efficiency. However, it will be understood that the total energy which can be coupled through such an actuator, as well as the power available for supplying such energy, (in an actively powered embodiment) is relatively limited both by the dimensions of the mechanical structure and available space or weight loading, and other factors. Accordingly, the exact location and positioning as well as the dimensioning and selection of suitable material is a matter of some technical importance both for a ski and for any other sports implement, as will be understood from the discussion in the aforesaid Sports Implement patent application, of specific factors to consider in implementing this sports damper construction.

In general, the piezo actuation sheet assembly may be substantially similar to the QUICKPACK actuators, a commercial product packaged electroactive assembly sold by ACX, Inc. of Cambridge, Mass. In these devices the electroactive material, consisting of one or more piezoceramic sheets, is incorporated into a card which may in turn be assembled in or onto other structures to efficiently apply the strain energy available in the actuating element. Applicant's prior U.S. patent application Ser. No. 08/188,145 filed on Jan. 27, 1994, and applicant's corresponding PCT publication WO 95/20827 describe the fabrication of such thin stiff cards with sheet members in which substantially the entire area is occupied by one or more piezoceramic sheets encapsulated in a manner to provide a tough supporting structure for the delicate piezo member, yet to allow its in-plane energy to be efficiently coupled across one or both of its major faces. Accordingly, it will be understood in the discussion below that the electroactive sheet elements described herein are preferably substantially similar or identical to those described in the aforesaid patent application, or are elements which are embedded in, or supported by sheet material as described therein such that their coupling to the skis provides a non-lossy and highly effective transfer of strain energy therebetween across a broad area piezo actuator surface.

Figure 1A:
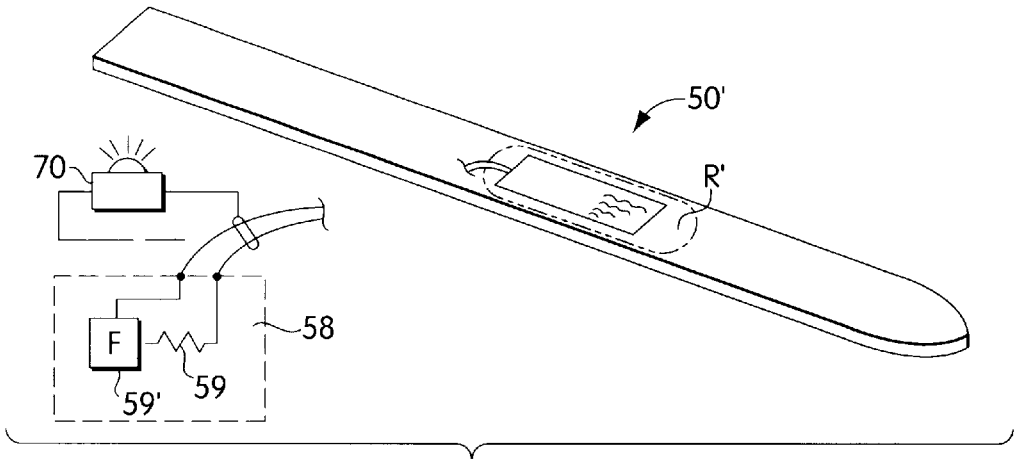
FIGS. 1A and 1B show details of a passive damper embodiment of the ski of FIG. 1.

FIG. 1A illustrates general aspects of a sports implement 50' in accordance with applicant's invention. Here a single sensor/actuator sheet element 56 covers a region R' of the ski and its strain-induced electrical output is connected across a shunt loop 58. Shunt loop 58 contains a resistor 59 and filter 59' connected across the top and bottom electrodes of the actuator 56, so that as strain in the region R creates charge in the actuator element 56, the charge flows through the resistor 59 and is dissipated. The mechanical effect of this construction is that strain changes occurring in region R' within the band of filter 59' are continuously dissipated, resulting, effectively, in damping of the modes of the structure. While it is possible to entirely cover the ski with active material, in practice considerations of weight, strength and cost allow the element 56 to cover about five to ten percent of the surface, and capture up to about five percent of the strain energy in the ski. The strain energy in the piezo alters its charge state, and the filter/shunt then returns and dissipates this charge to alter the strain in the ski. Since most vibrational states actually take a substantial time period to build up, this continuous low level of mechanical compensation is effective to control serious mechanical effects of vibration, and to noticeably alter the response of the ski.

As noted in the aforesaid Sports Implement patent application Ser. No. 08/536,067, in practice, the intrinsic capacitance of the piezoelectric actuators operates to filter the signals generated thereby or applied thereacross, so that a separate filter element 59' need not necessarily be provided, and the piezo charge may be simply shunted through a suitable resistor.

Figure 1B:
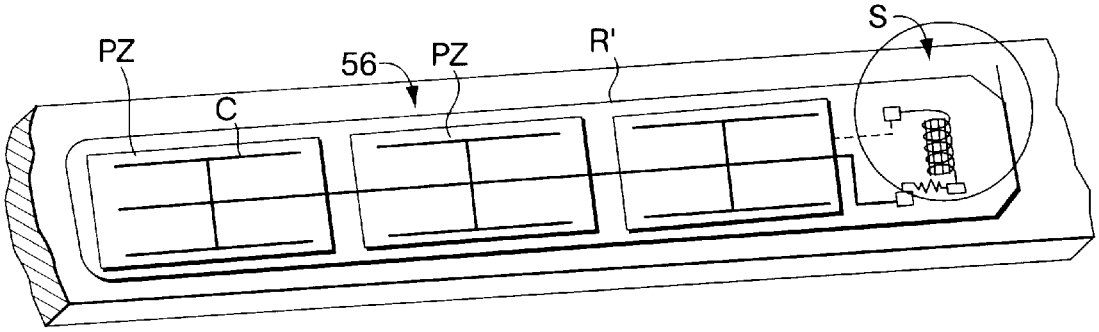

One generally useful construction of this type described in the '067 patent application and illustrated in FIG. 1B of that application was a resistively shunted construction in which three lead zirconium titanate (PZT) ceramic sheets PZ were laminated to flex circuit material in which corresponding trellis-shaped conductive leads C spanned both the upper and lower electroded surfaces of the PZT plates. Each sheet was 1.81 by 1.31 by 0.058 inches, forming a modular card-like assembly approximately 1.66×6.62 inches and 0.066 inches thick. The upper and lower electrode lines C extend to a shunt region S at the front of the modular package, in which they are interconnected via a pair of shunt resistors so that the charge generated across the PZT elements due to strain in the ski is dissipated. The resistors are surface-mount chip resistors, and one or more surface-mount LED's 70 are connected across the leads to flash as the wafers experience strain and shunt the energy thereof. This provides visible confirmation that the circuit lines remain connected. The entire packaged assembly was mounted on the top structural surface layer of a ski to passively couple strain out of the ski body and continuously dissipate that strain. Another prototype damped ski employed four PZT ceramic sheets arranged in a line. Reference is made to the aforesaid Sports Implement patent application for a more complete description of the constructions contemplated for actuator placement, and regimens for shunting or actuating the piezo sheets. When used with a sensor and piezo drive circuit, for example, the active circuit elements 26 may include elements for amplifying the level of signal provided to the actuator and processing elements, for phase-shifting, filtering and switching, or logic discrimination elements to actively apply a regimen of control signals determined by a control law to the electroactive elements 25. In the latter case, all or a portion of the controller circuitry may be distributed in or on the actuator, or on sensing elements of the electroactive assembly itself, for example as embedded or surface mounted amplifying, shunting, or processing elements as described in the aforesaid U.S. patent applications.

The damping factor of the damper depends on its dissipation of strain energy, and in the passive construction of FIG. 1A, dissipation is achieved with a simple resistive shunt circuit attached to the electroactive elements. Since the exact vibrational frequencies of a sports implement are not known or readily observable due inter alia to the variability of the human using it and the conditions under which it is used, one approach is to apply a broad band passive shunt such as a resistor tuned in relation to the capacitance of the piezo sheet, to optimize the damping in the damper near the specific frequencies associated with the modes to be damped. The optimal shunt resistor is found from the vibration frequency and capacitance of the electroactive element as follows:

$$R_{opt}=a1^{*}\ (1/(\omega c)) \tag{1}$$

where the constant al depends on the coupling coefficient of the damping element. One ski employed a piezoceramic damper module as described in the above-referenced patent application, with the shunt circuit connected to the electroactive elements via flex-circuits which, together with epoxy and spacer material, form an integral damper assembly. Preferably an LED is placed across the actuator electrodes, or a pair of LEDs are placed across legs of a resistance bridge to achieve a bipolar LED drive at a suitable voltage, so that the LED flashes to indicate that the actuator is strained and shunting, i.e., that the damper is operating. This configuration is shown in FIG. 1A by LED 70. As noted in the aforesaid patent application such an optimized resistive shunt damper design added only 4.2% in weight to the ski, yet was able to add 30% additional damping. The materials of which the ski was manufactured were relatively stiff, so the natural level of damping was below one percent. The additional damping due to a shunted piezoelectric sheet actuator amounted to about one-half to one percent damping, and this small quantitative increase was unexpectedly effective to decrease vibration and provide greater stability of the ski. The aforesaid design employed electroactive elements over approximately 10% of the ski surface, with the elements being slightly over 1/16th of an inch thick, and, as noted, it increased the level of damping by a factor of approximately 30%. The simple shunt resistance passively dissipates strain energy entering the electroactive element fairly uniformly over a broad range of frequencies.

Figure 2:
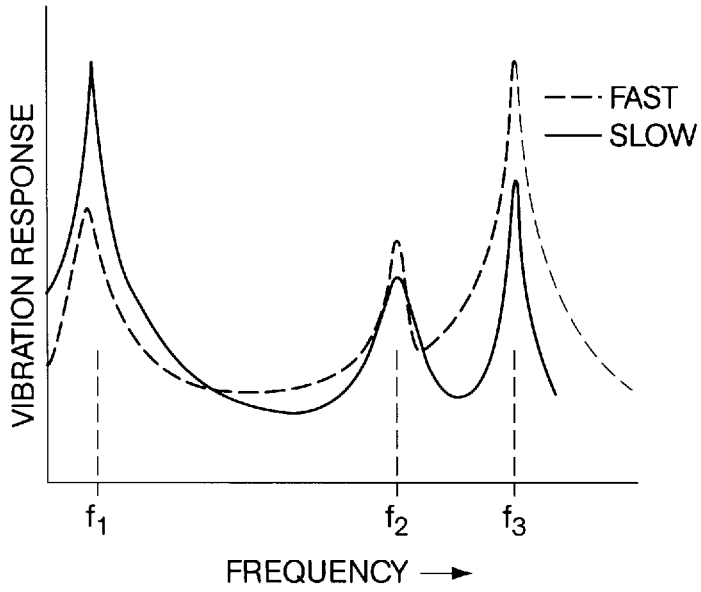
FIG. 2 illustrates representative mode excitations in a ski under two different conditions of use.

The present invention seeks to improve the damping in particular circumstances. FIG. 2 illustrates one situation addressed by the present invention and shows a plot of amplitude versus frequency of the vibrational response of a ski to two different sets of ski conditions. As generally illustrated in FIG. 2, the ski has a number of vibrational modes at frequencies $f_1$, $f_2$, $f_3$ . . . which illustratively in one tested ski were centered at approximately 12, 60, and 110 Hz. The solid line in the Figure illustrates the relative amplitude of these vibrational states during slow skiing, while the dotted line illustrates the relative amplitude of these modes occurring at a much faster speed. While each of the principal modes is excited, the lower frequency modes are excited more at lower ski velocity and the higher frequency modes achieve higher amplitudes at high speed. This is believed to be because the higher speeds cause more frequent bumps and impulses which are better aligned to stimulate the higher frequency vibrational modes. As shown in FIG. 2, the first mode is actually excited to a lesser extent during high speed skiing than during low speed skiing, and, in fact, its amplitude may be already less than the low speed first mode vibration after damping by the resistive shunt of FIG. 1A. On the other hand, the amplitudes of the second and higher modes grow with ski velocity.

Applicant has determined it to be desirable to damp one or more of these higher modes to a greater degree with the same piezo damper sheet assembly. This is accomplished in accordance with a basic embodiment of the present invention by tuning the passive shunt to selectively operate with higher efficiency at a particular resonance band such as the second, or the second and third modes, characteristic of higher speed skiing, or to operate at the first mode excited by low speed skiing.

In designing a piezoceramic plate shunt one faces several limitations. First, the plates themselves are necessarily manufactured in standard sizes and have a fixed capacitance range as a function of their area, dielectric properties and thickness. By placing a shunt resistor across the plates the shunted capacitance will have characteristic output voltage, hence feedback current, which places an upper limit on the efficiency of its operation. By tuning the shunt circuit to a mode, it may be possible to shunt more of the energy of that mode. However, a second constraint is that apparently identical skis may be manufactured in different sizes, with a corresponding shift in their resonance modes, or may be manufactured with variations and tolerances of components that result in a shift of the modes, so that, for example, the second resonance of a ski may fall at 55 or 65 Hz, rather than a nominal 60 Hz value. In that case, a shunt tuned to optimally damp a 60 Hz resonance will prove less effective for a shifted resonance.

Applicant has therefore determined to not simply tune a control circuit to effectively shunt a particular frequency, but to provide a robust shunt that operates effectively to shunt with enhanced efficiency over a band of expected frequencies. This band may include frequency variations due to manufacturing tolerances, temperature-induced variations, or circuit component variations.

Figure 3:
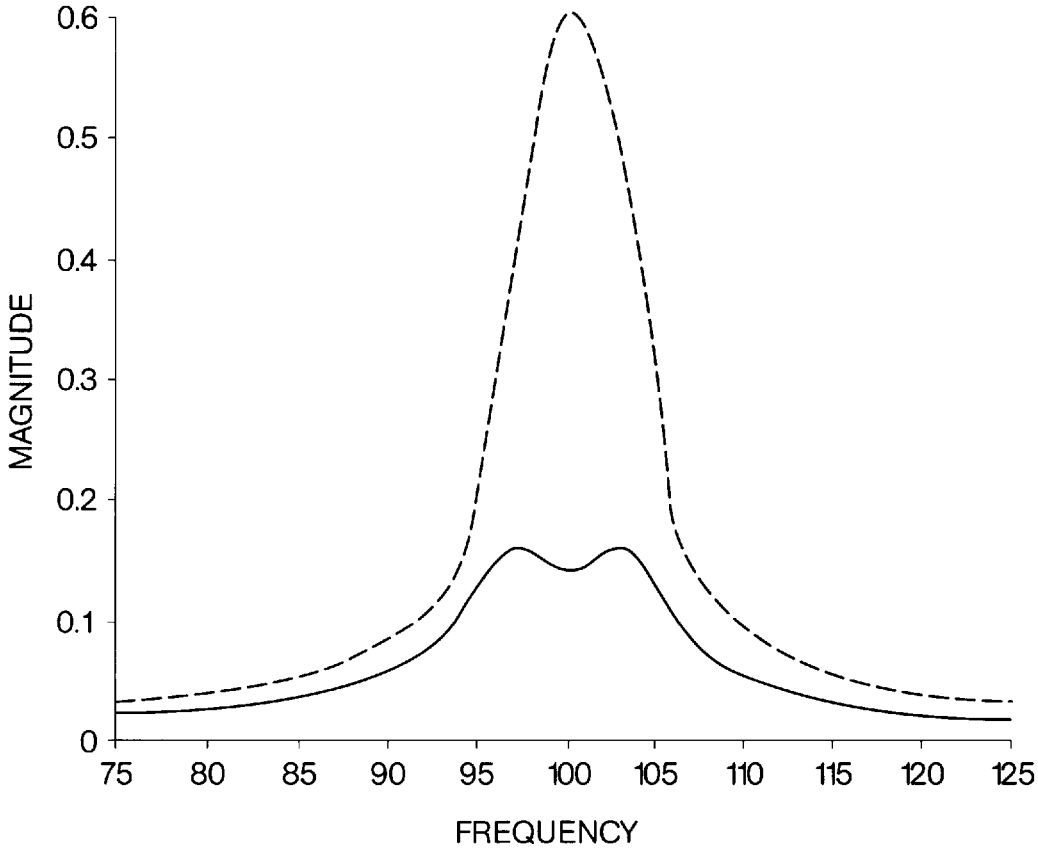
FIG. 3 illustrates representative damping of a mode with a highly tuned piezo shunt circuit.
Figure 3A:
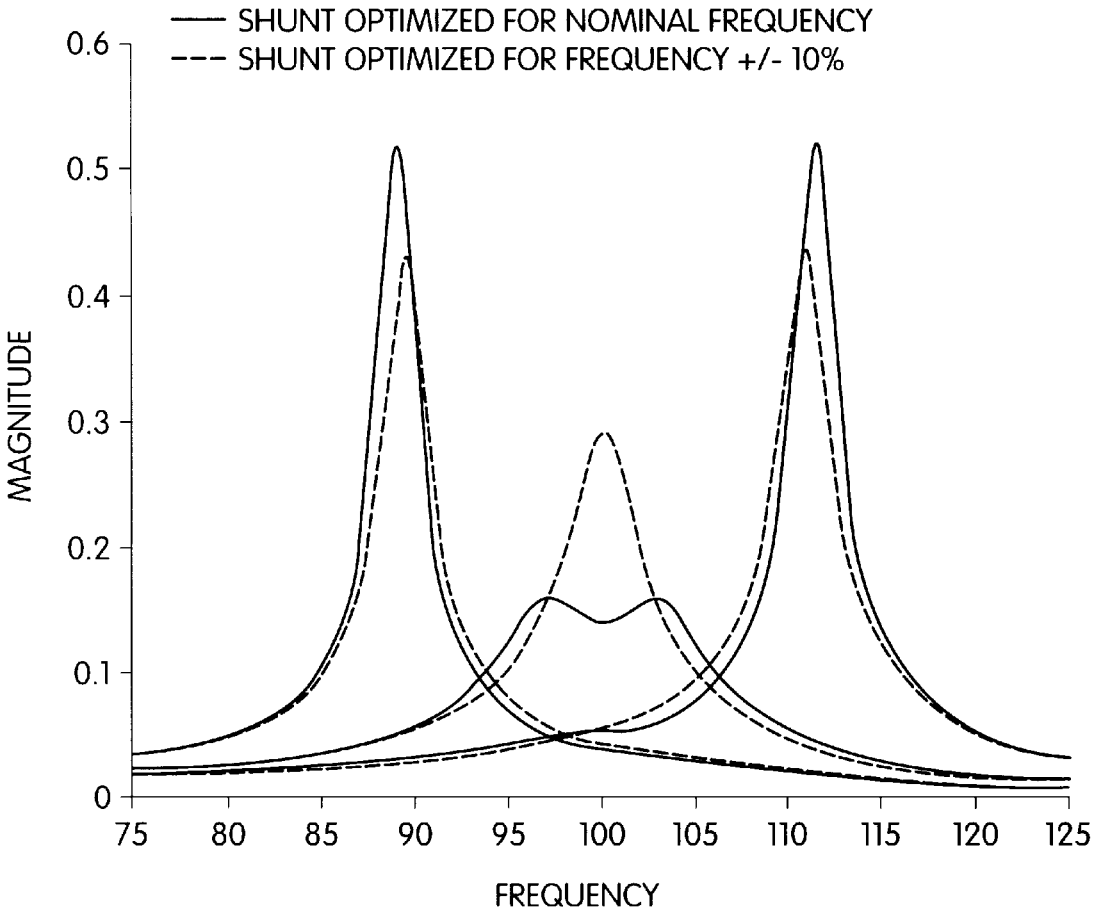
FIG. 3A is a comparative graph contrasting the damper of FIG. 3 with the damper of the present invention.

The present invention achieves this construction and addresses these several constraints by providing a shunt circuit having an inductive element which tunes the circuit to a nominal resonant frequency but has a Q optimized to include a performance band extending on either side of the resonance. FIGS. 3 and 3A illustrate this situation. In FIG. 3, there is shown a damping response of a ski having a nominal resonance at 100 Hz and damped by a highly tuned resonant shunt. As shown, the highly tuned shunt reduces amplitude of the 100 Hz center frequency from an initial value of 1.0 to approximately 15% of that value, with the greatest damping occurring at the center frequency. In operation the values of the shunt circuit elements across the piezo sheet are selected to resonate at the modal resonance, illustratively 100 Hz, so that when the piezo is strained at that frequency the voltage across the piezo plates is higher and a higher current flows through the resistor, maximizing the power, $i^2R$, dissipated by the shunt. However, when the shunt circuit is sharply tuned to a single resonance, it considerably less effective at damping vibrations near, but not at, the resonance. Applicant undertook to model the relative effectiveness of the shunt damper given an expected range of modal frequencies. FIG. 3A illustrates the effect of such a highly tuned resonant shunt on three separate peaks at 90, 100 and 110 Hz, respectively. The solid lines indicate net amplitude of the three peaks, each assumed to have been of unit amplitude. As shown, the highly tuned shunt is considerably less effective at damping resonances occurring 10 Hz to either side of the tuned band achieving only about 40% reduction of the peak amplitude instead of 80%.

Applicant therefore undertook to enhance damping over the range of expected frequency values. To determine a suitable tuning, applicant modeled each resonance of the ski as falling somewhere in a band which may, for example, extend 10% on either side of the nominal resonance, and assumed that the actual resonant frequency will also vary since it depends upon a number of parameters such as the type of terrain, the frictional properties of the underlying snow, and the particular portion or amount of ski area currently in contact with the terrain. Applicant provided a shunt circuit which, rather than having a relatively high resistance to narrowly tune the shunt resonance, or a low resistance to increase current without substantial resonant effect, provides a resistance that tunes the RLC circuit to provide a reasonable amount of damping over a broader band without attaining the high peak damping at a center frequency. In FIG. 3A, the dashed lines indicate the amount of damping modeled for this shunt for three separate peaks at 90, 100 and 110 Hz, each originally of unit amplitude. As shown, an effective level of damping in the range of 70% is obtained at the center frequency, while at the fringes a slightly lower level of 60% damping occurs at the center frequency. While the lower Q shunt allows the nominal 100 Hz vibration to reach a level somewhat above the peak obtained from a highly tuned shunt, good damping is obtained for the other likely values of the third mode resonance. The damper is robust, in that it works effectively on substantially all skis of the production model, on substantially all terrains under the chosen (high speed) third mode excitation conditions.

When implemented in a production ski, the ski was found to have an expected third longitudinal resonance mode at approximately 112 Hz. A piezo plate damping assembly was constructed having three plates each 58 mils thick and 1.81 by 1.31 inches wide, arranged next to each other in one row in a single layer. Total plate capacitance was approximately 88 nf and an inductor of 22 Henrys was applied across the circuit in series with a resistance, that together with the inductor's resistance of 2.4 kω forms a 3.2 kω shunt across the plates, obtaining substantial resonant voltage increase over the frequency range 112 Hz±10%. The relatively high resistance value provides a lower Q resonance circuit, even through this entails lowering the current dissipated in the resistor from that of a higher Q "tuned" 112 Hz circuit.

The desired shunt characteristics were determined by modeling the system and adjusting parameters to minimize the $H_2$ response (in the control systems sense) of three systems simultaneously. One system was taken to have a resonance frequency equal to the nominal frequency of the target mode, 112 Hz. The second had a resonance equal to the minimum expected resonant frequency for that mode, and the third had a resonance equal to the maximum expected frequency of that mode. The optimization was done in the minmax sense:

$$R_{opt}, L_{opt} = \min_{R,L} \max(G_1(R, L), G_2(R, L), G_3(R, L))$$

Where $G_1$ is the $H_2$ (or $H_\infty$) response of the nominal system as a function of R and L, and $G_2$ and $G_3$ are the corresponding responses for the systems with frequency set to the maximum and minimum expected values of the resonant frequency, $f_1$, $f_2$, $f_3$ above. The minimax calculation was performed in a straightforward way using the MFILES language of MATLAB, and the values of R, L were chosen to optimize power dissipation through the shunt for the composite system constraints, e.g. the RMS energy over the band ($H_2$) or the total energy at the three frequencies ($H_\infty$). A relatively large resistance value was chosen to tune the shunt to provide substantial damping over a range of expected modal or excitation frequencies. Further, the inductor was allowed to saturate since this saved substantial weight in the assembly.

The foregoing shunt design results in a robust shunt that produces dependable level of damping without unexpected performance loss when changes in operating conditions or terrain occur, and without extreme loss of efficiency when faced with manufacturing variations and device tolerances. In particular, by designing a broad band inductive shunt, component tolerances could be allowed a wide degree of latitude, with low tolerance resistors having values varying by up to 5%, the inductor values varying up to 15% and the plate capacitance of the piezo sheets up to 10% in either direction. The entire circuit is capable of substantial miniaturization. The inductor was wound on a core which was mounted mid-plane in the circuit board forming the piezo strain control unit, and thus extended partly into the ski below the surface of the ski. The resistance elements were chip mounted resistors centered between conductive lines of the strain element circuit package, and also sealed beneath the surface of the ski. The technique is of general applicability and corresponding resistance and inductance values are readily calculated for the different capacitance of strain control modules having any number of piezo sheets, or pairs of piezo sheets in the damping assembly, as well as for optimizing control of different vibrational modes.

Greater areas of actuator material could be applied with either the passive or an active control regimen to obtain more pronounced damping affects. Furthermore, as knowledge of the active modes a ski becomes available, the invention contemplates particular switching or control implementation may be built into the damper or into separate drive or shunt circuitry to specifically attack such problems as resonant modes which arise under particular conditions, such as hard surface or high speed skiing, or to select the damped modes by switching between different feedback shunts as conditions vary.

The actuator is also capable of selectively increasing vibration. This may be desirable to excite ski modes which correspond to resonant undulations that may in certain circumstances reduce frictional drag of the running surfaces. It may also be useful to quickly channel energy into a known mode and prevent uncontrolled coupling into less desirable modes, or those modes which couple into the ski shapes required for turning.

In addition to the applications to a ski described in detail above, the present invention has broad applications as a general sports damper which may be implemented by applying the simple modeling and design considerations as described above. Thus, corresponding actuators may be applied to the runner or chassis of a luge, or to the body of a snowboard or cross country ski. Furthermore, electroactive assemblies may be incorporated as portions of the structural body as well as active or passive dampers, or to change the stiffness, in the handle or head of sports implements such as racquets, mallets, golf clubs and sticks for which the vibrational response may affect the players' handling rather than or in addition to the object being struck by the implement. It may also be applied to the frame of a sled, bicycle or the like. In each case, the sports implement of the invention is constructed by modeling the modes of the sports implement, or detecting or determining the location of maximal strain for the modes of interest, and applying electroactive assemblies material at the regions of high strain, and shunting or energizing the material optimally dissipate energy over a performance or tolerance band around one or more nominal modes to control the device.

Rather than modeling vibrational modes of a sports implement to determine an optimum placement for a passive sensor/actuator or an active actuator/sensor pair, the relevant implement modes may be empirically determined by placing a plurality of sensors on the implement and monitoring their responses as the implement is subjected to use. Once a "map" of strain distribution over the implement and its temporal change has been compiled, the regions of high strain are identified and an actuator is located, or actuator/sensor pair interlocated there to affect the desired dynamic response.

A ski interacts with its environment by experiencing a distributed sliding contact with the ground, an interaction which applies a generally broad band excitation to the ski. This interaction and the ensuing excitation of the ski may be monitored and recorded in a straightforward way, and may be expected to produce a relatively stable or slowly evolving strain distribution, in which a region of generally high strain may be readily identified for optional placement of the electroactive assemblies. A similar approach may be applied to items such as bicycle frames, which are subject to similar stimuli and have similarly distributed mechanics.

An item such as mallet or racquet, on the other hand, having a long beam-like handle and a solid or web striking face at the end of the handle, or a bat with a striking face in the handle, generally interacts with its environment by discrete isolated impacts between a ball and its striking face. As is well known to players, the effect of an impact on the implement will vary greatly depending on the location of the point of impact. A ball striking the "sweet spot" of a racquet or bat will efficiently receive the full energy of the impact, while a glancing or off-center hit with a bat or racquet can excite a vibrational mode that further reduces the energy of the hit and also makes it painful to hold the handle. For these implements, the discrete nature of the exciting input makes it possible to excite many longitudinal modes with relatively high energy. Furthermore, because the implement is to be held at one end, the events which require damping for reasons of comfort, will in general have high strain fields at or near the handle, and require placement of the electroactive assembly in or near that area. However, it is also anticipated that a racquet may also benefit from actuators placed to damp circumferential modes of the rim, which may be excited when the racquet nicks a ball or is impacted in an unintended spot. Further, because any sports implement, including a racquet, may have many excitable modes, controlling the dynamics may be advantageous even when impacted in the desired location. Other sports implements to which actuators are applied may include luges or toboggans, free-moving implements such as javelins, poles for vaulting and others that will occur to those skilled in the art.

The actuators may also be powered to alter the stiffness of the shaft of a golf club or to affect its head. In general, when applied to affect damping, increased damping will reduce the velocity component of the head resulting from flexing of the handle, while reduced damping will increase the attainable head velocity at impact. Similarly, by energizing the actuators to change the stiffness, the "timing" of shaft flexing is altered, affecting the maximum impact velocity or transfer of momentum to a struck ball.

As indicated above for the passive constructions, control is achieved by coupling strain from the sports implement in use, into the electroactive elements and dissipating the strain energy by a passive shunt or energy dissipation element. In an active control regimen, the energy may be either dissipated or may be effectively shifted, from an excited mode, or opposed by actively varying the strain of the region at which the actuator is attached. Thus, in other embodiments they may be actively powered to stiffen or otherwise alter the flexibility a shaft or body.

The invention being thus disclosed and described, further variations will occur to those skilled in the art, and all such variations and modifications are consider to be with the spirit and scope of the invention described herein and its equivalents, as defined in the claims appended hereto.

What is claimed is:

1. A ski comprising a ski body;

an electroactive assembly mounted on said ski body and including an electroactive sheet strain element for transducing electrical energy and mechanical strain energy, said electroactive assembly being coupled to said body in a region of strain, and a control circuit comprising at least one band-limited circuit element and a switch, said control circuit being placed across said electroactive assembly and operative to preferentially alter dynamic response of said ski body to stimulation.

2. A ski according to claim 1, wherein said circuit element is a shunt across the sheet strain element and is tuned to enhance damping in a narrow frequency band.

3. A ski according to claim 1, wherein circuit element is tuned to preferentially damp a specific vibrational mode of the ski body.

4. A ski according to claim 1, wherein the circuit element is a band optimized shunt centered at about 110 Hz.

5. A ski according to claim 1, wherein said stimulation excites structural modes of said ski body giving rise to a strain distribution including a region of high strain, and said assembly is coupled in the region of high strain to shift or damp excitation of modes and thereby improve handling of said ski.

6. A ski according to claim 1, wherein said assembly is coupled by a substantially shear free coupling to said region of high strain.

7. A ski according to claim 1, wherein said circuit element comprises an inductor of a size to saturate with electrical energy generated by said electroactive sheet strain element.

8. A ski according to claim 1, wherein said circuit element comprises an inductor and a resistor selected to form, together with intrinsic capacitance of said strain element, a narrow band resonant circuit.

9. A ski according to claim 8, wherein the resistor adds resistance to said circuit to create a tolerance band.

10. A ski according to claim 8, wherein said circuit element is tuned by increasing its resistance to decrease its sensitivity to manufacturing tolerances.

11. A ski according to claim 8, wherein the narrow band encompasses a ski resonance within a tolerance band representative of manufacturing and size variation.

12. A ski according to claim 9, wherein said narrow band encompasses a ski free resonance and a tolerance band corresponding to changing frequency of the resonance in use.

13. A ski according to claim 1, wherein said circuit element is tuned to preferentially damp oscillation in a frequency band centered around a nominal ski body mechanical mode which is stimulated under a defined set of operating conditions.

14. A method of controlling a ski, such method comprising the steps of locating an area of high strain in a range of skiing conditions;

mounting an electroactive strain element on the ski, and placing a control circuit across said electroactive element, said control circuit comprising at least one band-limited circuit element and a switch, and operative to preferentially alter dynamic response of said ski body to stimulation.

15. The method of claim 14, wherein the step of mounting an electroactive strain element on the ski includes mounting a sheet of piezoceramic material on the ski, and the circuit element is an inductive shunt tuned in relation to capacitance of said sheet.

16. The method of claim 15, wherein said shunt is effective to reduce peak vibration amplitude between about twenty and eighty percent over a range of frequencies encompassing said specific mode, said range including frequency variations of the mode due to operating conditions or manufacturing tolerances.

17. The method of claim 16, wherein said inductive shunt is tuned to enhance dissipation of electrical energy at frequencies inside of said range of frequencies and away from an adjacent mode of the ski.

18. The method of claim 14, wherein said switch is operative to select between two shunt values for preferentially enhancing damping of at least two different modes of the ski.

19. The method of claim 18, wherein said switch is operative for preferentially enhancing damping under different skiing conditions.

20. A method of damping a sports implement, such method comprising locating a region of high strain in the sports implement;

mounting an electroactive element to the sports implement in said region to receive strain energy therefrom and produce electrical charge which varies with said strain energy, placing a control circuit across said electroactive element, said control circuit comprising at least one band-limited inductive shunt and a switch, and operative to preferentially alter dynamic response of said ski body to stimulation; and inductively shunting said charge to alter strain in said region thereby changing response of the sports implement in use.

21. The method of claim 20, wherein the sports implement is a ski and the step of inductively shunting includes preferentially shunting a frequency band to selectively damp one or more targeted modes of the ski.

22. The method of claim 20, wherein the sports implement is selected from among a bat, a golf club, a racquet and a runnered vehicle, and the step of inductively shunting includes preferentially shunting a frequency band to selectively damp a targeted mode of a corresponding bat, golf club head or shaft, racquet head or shaft, or a runner, respectively.

23. The method of claim 20, wherein the step of inductively shunting includes shunting in a low Q circuit tuned to optimize damping over a frequency band having a band width encompassing dynamic or component-induced variation of a resonance frequency.

24. A sports implement comprising a body an electroactive assembly mounted on said body and including an electroactive sheet strain element for transducing electrical energy and mechanical strain energy, said electroactive assembly being coupled to said body in a region of strain, and a control circuit comprising at least one band-limited circuit element and a switch, said control circuit being placed across said electroactive assembly and operative to preferentially alter dynamic response of said body to stimulation.

* * * * *